US011041506B2

(12) United States Patent
Kim et al.

(10) Patent No.: US 11,041,506 B2
(45) Date of Patent: Jun. 22, 2021

(54) BLOWER FAN AND AIR CONDITIONER HAVING SAME

(71) Applicant: Samsung Electronics Co., Ltd, Gyeonggi-do (KR)

(72) Inventors: Byung-ghun Kim, Suwon-si (KR); Keun-jeong Jang, Yongin-si (KR); Yong-ho Seo, Hwaseong-si (KR); Hyeong-joon Seo, Suwon-si (KR); Eun-sung Jo, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 432 days.

(21) Appl. No.: 15/780,221

(22) PCT Filed: Nov. 4, 2016

(86) PCT No.: PCT/KR2016/012616
§ 371 (c)(1),
(2) Date: May 30, 2018

(87) PCT Pub. No.: WO2017/095029
PCT Pub. Date: Jun. 8, 2017

(65) Prior Publication Data

US 2018/0355885 A1 Dec. 13, 2018

(30) Foreign Application Priority Data

Nov. 30, 2015 (KR) ..... 10-2015-0168770

(51) Int. Cl.
*F04D 29/38* (2006.01)
*F04D 29/66* (2006.01)
(Continued)

(52) U.S. Cl.
CPC ..... *F04D 29/384* (2013.01); *F04D 29/667* (2013.01); *F24F 1/38* (2013.01);
(Continued)

(58) Field of Classification Search
None
See application file for complete search history.

(56) References Cited

U.S. PATENT DOCUMENTS 4,089,618 A * 5/1978 Patel ..... F04D 29/384 416/228
9,605,686 B2 * 3/2017 Hamada ..... F04D 29/386
(Continued)

FOREIGN PATENT DOCUMENTS

CN 1793670 A 6/2006
CN 200940604 Y 8/2007
(Continued)

OTHER PUBLICATIONS

Supplementary European Search Report dated Sep. 5, 2018 in connection with European Patent Application No. 16 87 0925, 6 pages.
(Continued)

*Primary Examiner* — Kayla Mccaffrey

(57) ABSTRACT

Disclosed are: a blower fan capable of reducing noise and power consumption; and an air conditioner having the same. The present device comprises: a hub connected to a driving member so as to receive rotating power; and a plurality of wings radially arranged along the circumference of the hub, wherein the plurality of wings can comprise: uneven parts formed at trailing edges, which are the rear edge portions of each wing, with respect to the rotational direction thereof; and tail wing parts formed on the outer sides of the uneven parts so as to have convex parts protruding farther than the uneven parts.

15 Claims, 10 Drawing Sheets

(51) Int. Cl.

| | |
|---|---|
| ***F24F 1/38*** | (2011.01) |
| ***F24F 13/24*** | (2006.01) |
| *F04D 29/32* | (2006.01) |

(52) U.S. Cl.

CPC ..... *F24F 13/24* (2013.01); *F04D 29/325* (2013.01); *F05D 2240/304* (2013.01); *F05D 2240/307* (2013.01)

(56) References Cited

U.S. PATENT DOCUMENTS

| | | | | |
|---|---|---|---|---|
| 9,726,190 | B2 | 8/2017 | Kumon et al. | |
| 2013/0091888 | A1 | 4/2013 | Park et al. | |
| 2014/0314575 | A1* | 10/2014 | Cho | F04D 29/681 416/170 R |
| 2014/0338388 | A1* | 11/2014 | Kim | F24F 13/24 62/426 |
| 2015/0240645 | A1 | 8/2015 | Yokose et al. | |
| 2015/0330223 | A1* | 11/2015 | Choi | F04D 29/384 416/204 R |
| 2018/0087784 | A1* | 3/2018 | Sawada | F04D 29/388 |

FOREIGN PATENT DOCUMENTS

| | | | |
|---|---|---|---|
| CN | 202833299 | U | 3/2013 |
| CN | 103047180 | A | 4/2013 |
| CN | 202914390 | U | 5/2013 |
| CN | 203098387 | U | 7/2013 |
| CN | 203516197 | U | 4/2014 |
| CN | 204126956 | U | 1/2015 |
| CN | 104641121 | A | 5/2015 |
| CN | 204553335 | U | 8/2015 |
| CN | 204572556 | U | 8/2015 |
| CN | 204716616 | U | 10/2015 |
| EP | 2581607 | A1 | 4/2013 |
| EP | 2607714 | A2 | 6/2013 |
| EP | 2902639 | A1 | 8/2015 |
| JP | 2-61400 | A | 3/1990 |
| JP | 2001073995 | A | 3/2001 |
| JP | 2003278696 | A | 10/2003 |
| JP | 2010101223 | A | 5/2010 |
| JP | 2013217312 | A | 10/2013 |
| JP | 2014080970 | A | 5/2014 |
| KR | 20-0314840 | Y1 | 5/2003 |
| KR | 10-2011-0075290 | A | 7/2011 |
| KR | 10-2013-0039481 | A | 4/2013 |
| KR | 10-2014-0136180 | A | 11/2014 |
| KR | 10-2014-0144402 | A | 12/2014 |
| WO | 2013/154100 | A1 | 10/2013 |

OTHER PUBLICATIONS

The Second Office Action in connection with Chinese Application No. 201680067536.2 dated May 26, 2020, 22 pages.

Communication pursuant to Article 94(3) EPC in connection with European Application No. 16870925.1 dated May 6, 2020, 4 pages.

International Search Report dated Feb. 8, 2017 in connection with International Patent Application No. PCT/KR2016/012616.

Written Opinion of the International Searching Authority dated Feb. 8, 2017 in connection with International Patent Application No. PCT/KR2016/012616.

Office Action dated May 28, 2019 in connection with Chinese Patent Application No. 201680067536.2 21 pages.

Office Action dated Feb. 3, 2021 in connection with Chinese Patent Application No. 201680067536.2, 21 pages.

* cited by examiner

BLOWER FAN AND AIR CONDITIONER HAVING SAME

CROSS-REFERENCE TO RELATED APPLICATIONS AND CLAIM OF PRIORITY

This application is a 371 of International Application No. PCT/KR2016/012616 filed Nov. 4, 2016, which claims priority to Korean Patent Application No. 10-2015-0168770 filed Nov. 30, 2015, the disclosures of which are herein incorporated by reference in their entirety.

TECHNICAL FIELD

The present disclosure relates to a blower fan and an air conditioner having the same, and more particularly, to a blower fan capable of reducing blowing noise and power consumption due to an operation of a propeller fan and an air conditioner having the same.

BACKGROUND

Air conditioner is an apparatus which keeps indoor air fresh to be suitable for human activity using a refrigeration cycle. The air conditioner cools the room through a repetitive operation which sucks hot air in a room, heat-exchanges the hot air into a low-temperature refrigerant, and discharges the refrigerant to the room. The air conditioners may heat the room through the reverse operation to the repetitive operation.

The air conditioner may cool or heat the room through a cooling cycle in which the air circulates in a compressor, a condenser, an expansion valve, and an evaporator in the forward or reverse direction. The compressor provides the high-temperature and high-pressure gaseous refrigerant and the condenser provides the room-temperature and high-pressure liquid refrigerant. The expansion value reduces the pressure of the room-temperature and high-pressure liquid refrigerant and the evaporator evaporates the pressure-reduced refrigerant to a low-temperature gas state.

The air conditioners may be divided into a separate type air conditioner in which an outdoor unit and an indoor unit are separated from each other and an integrated type air conditioner in which the indoor unit and the outdoor unit are integrally installed. Typically, in the separated type air conditioner, the compressor and the condenser (outdoor heat exchanger) are provided in the outdoor unit and the evaporator (indoor heat exchanger) is provided in the indoor unit. The refrigerant circulates and flows in the outdoor unit and the indoor unit via a pipe which couples the indoor unit and the outdoor unit.

The outdoor unit in the separate type air conditioner includes the compressor, the condenser, a blower fan, a driving motor which rotates the blower fan, and the like. The driving motor rotates the blower fan, condenses the refrigerant to a liquid state through heat exchange with the gaseous refrigerant flowing inside the condenser of the outdoor unit, and discharges the condensed refrigerant to the outside.

DETAILED DESCRIPTION OF THE INVENTION

Summary

The object of the present disclosure is to provide a blower fan capable of reducing blowing noise and power consumption and an air conditioner having the same.

According to an embodiment of the present invention, a blower fan may include a hub coupled to a driving member and configured to receive rotation force; and a plurality of wings radially arranged along a circumference of the hub. Each of the plurality of wings may include an uneven part formed at a trailing edge which is a rear edge portion of the wing with respect to a rotational direction thereof; and a tail wing part having a convex portion which is formed on an outer side of the uneven part and protrudes rather than the uneven part.

A position P1 of the tail wing part may be located in a section $0.85*D \leq P1 \leq D$ on the basis of a maximum straight distance D of the wing from a center C of the hub.

A position P2 of the uneven part may be located in the section $0.5*D \leq P2 \leq 0.9*D$.

The uneven part may be located from an inner end of the tail wing part toward the center C of the hub by an interval of 0.01*D or less.

The tail wing part may have an inclined portion which is coupled to an inner side of the convex portion and is arranged to be inclined upward toward the convex portion.

A protruding portion of the uneven part which protrudes from a surface of the trailing edge and a recessed portion of the uneven part which is recessed from the surface of the trailing edge may be alternately arranged and the recessed portion may be located closest to the convex portion.

The protruding portion may have a convex shape to have a preset curvature.

The protruding portion may have a polygonal shape.

The convex portion may have a convex shape to have a preset curvature and protrude backward rather than the uneven part with respect to the rotational direction.

An outer end of the tail wing part may be located in an end portion of the wing.

According to an embodiment of the present invention, an air conditioner may include a blower fan configured to cool a refrigerant. The blower fan may have a plurality of wings. Each of the plurality of wings may include an uneven part formed at a trailing edge which is a rear edge portion of the wing with respect to a rotational direction thereof; and a convex portion formed on an outer side of the uneven part and having a preset curvature to protrude backward rather than the uneven part with respect to the rotational direction.

The wing may further include a tail wing part formed in an end portion of a trailing edge of the wing and the convex portion may be provided in the tail wing part.

The blower fan may further include a hub coupled to a driving shaft and configured to receive rotation force.

The plurality of wings may be arranged along a circumference of the hub. A position P1 of the tail wing part may be located in a section $0.85*D \leq P1 \leq D$ on the basis of a maximum straight distance D of the wing from a center C of the hub.

A position P2 of the uneven part may be located in a section $0.5*D \leq P2 \leq 0.9*D$.

The uneven part may be located from an inner end of the tail wing part toward the center C of the hub by an interval of 0.01*D or less.

The tail wing part may have an inclined portion which is coupled to an inner side of the convex portion and is arranged to be inclined upward toward the convex portion.

A protruding portion of the uneven part which protrudes from a surface of the trailing edge and a recessed portion of the uneven part which is recessed from the surface of the trailing edge may be alternately arranged and the recessed portion may be located closest to the convex portion.

The protruding portion may have a convex shape to have a preset curvature.

The protruding portion may have a polygonal shape.

An outer end of the tail wing part may be located in an end portion of the wing. To obtain the above-described object, according to an embodiment of the present invention, an air conditioner may include a blower fan configured to cool a refrigerant. The blower fan may have a plurality of wings.

Each of the plurality of wings may include an uneven part formed at a trailing edge which is a rear edge portion of the wing with respect to a rotational direction thereof; and a convex portion formed on an outer side of the uneven part and having a preset curvature to protrude from the uneven part.

DETAILED DESCRIPTION

Figure 1:
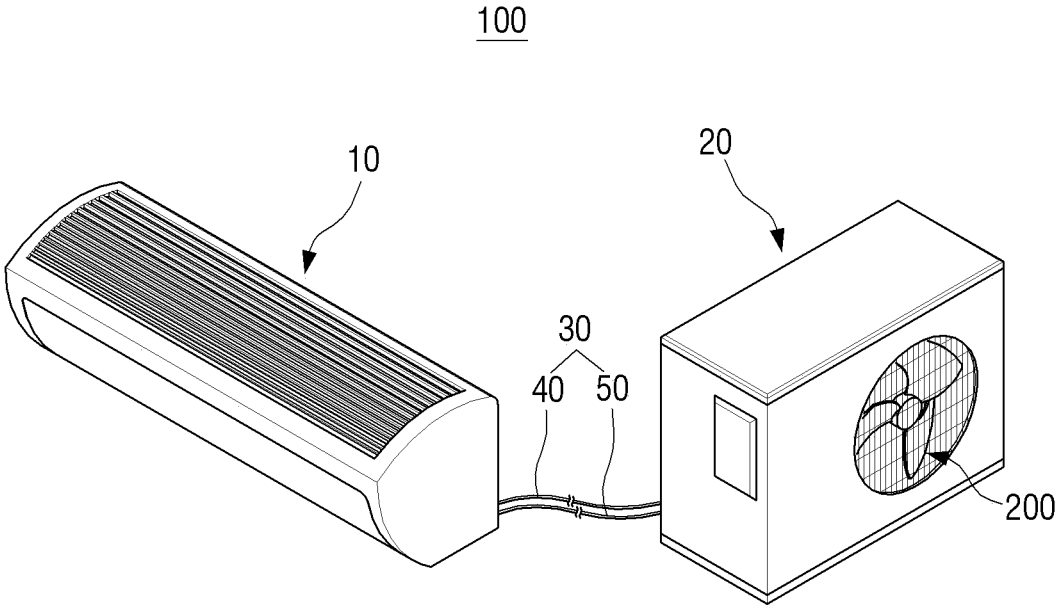
FIG. 1 is a schematic diagram illustrating an air conditioner according to an embodiment of the present invention.

Hereinafter, embodiments of the present invention will be described in detail with reference to the accompanying FIGS. 1 to 10. The embodiments described herein will be exemplarily described based on embodiments most suitable to understand technical features of the present invention. It is understood that the technical features of the present invention are not limited by the embodiments described herein but are illustrated to implement the present invention like the embodiments described herein.

Various modifications, equivalents, and/or alternatives of the embodiments may be included therein without departing from the principles and spirit of the present disclosure. In the following description, unless otherwise described, the same reference numerals are used for the same elements when they are depicted in different drawings.

FIG. 1 is a schematic diagram illustrating an air conditioner according to an embodiment of the present invention. Referring to FIG. 1, an air conditioner 100 includes an indoor unit 10 and an outdoor unit 20. The indoor unit 10 and the outdoor unit 20 may be coupled to a coupling pipe 30. The coupling pipe 30 may include a refrigerant supply pipe 40 and a refrigerant discharge pipe 50. The refrigerant may circulate in a refrigerant tube (not shown) provided in the indoor unit 10 and a refrigerant tube (not shown) provided in the outdoor unit 20 through the coupling pipe 30.

The indoor unit 10 may maintain the indoor temperature to an appropriate temperature by discharging the air heat-exchanged with the refrigerant compressed and condensed in the outdoor unit 20 to the room. The indoor unit 10 may include an expansion value and an evaporator. The indoor air may be cooled through the refrigerant evaporated in the evaporator.

The outdoor unit 20 may include a compressor, a condenser, and a blower fan 200. An air inlet through which external air flows in or flows out may be formed in one side of the outdoor unit 20. The compressor compresses the refrigerant and the compressed refrigerant flows and is condensed in the condenser. At this time, the blower fan 200 may be driven and the heat generated in the condenser may be cooled through the external air flowing through the air inlet and then discharged to the outside of the outdoor unit 20 again through the blower fan 200.

A propeller fan may be used as the blower fan 200 of the outdoor unit 20. The blower fan 200 may be used in the outdoor unit 20 of the air conditioner 100 and the like and may allow the air to forcibly flow by a difference between pressures in the front and rear of the blower fan.

Hereinafter, a structure of a blower fan will be described in detail with reference to the accompanying drawings.

Figure 2:
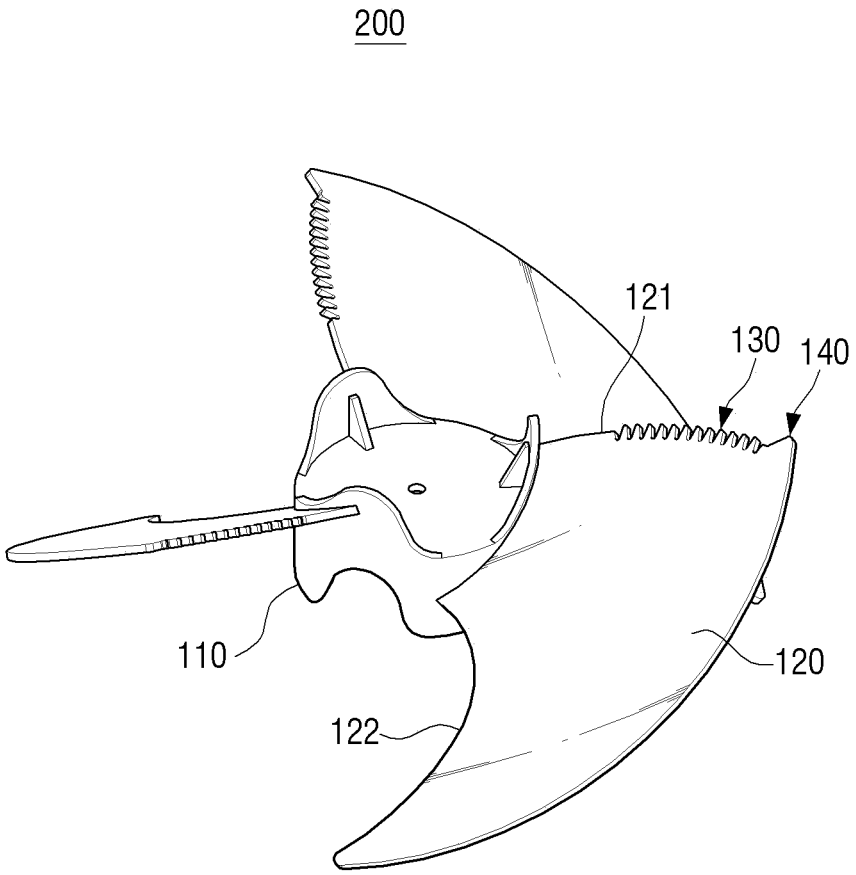
FIG. 2 is a perspective view illustrating a figure of a blower fan according to an embodiment of the present invention.
Figure 3:
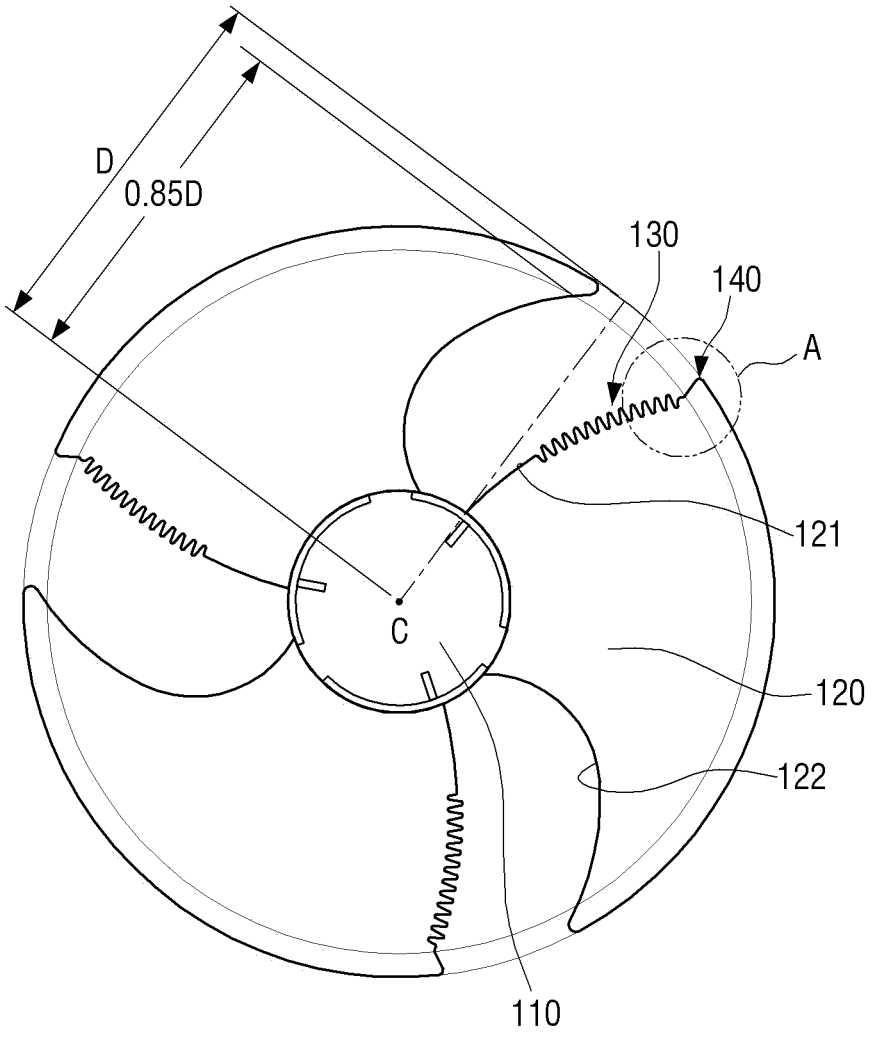
FIG. 3 is a front view illustrating a figure of a blower fan according to an embodiment of the present invention.
Figure 4:
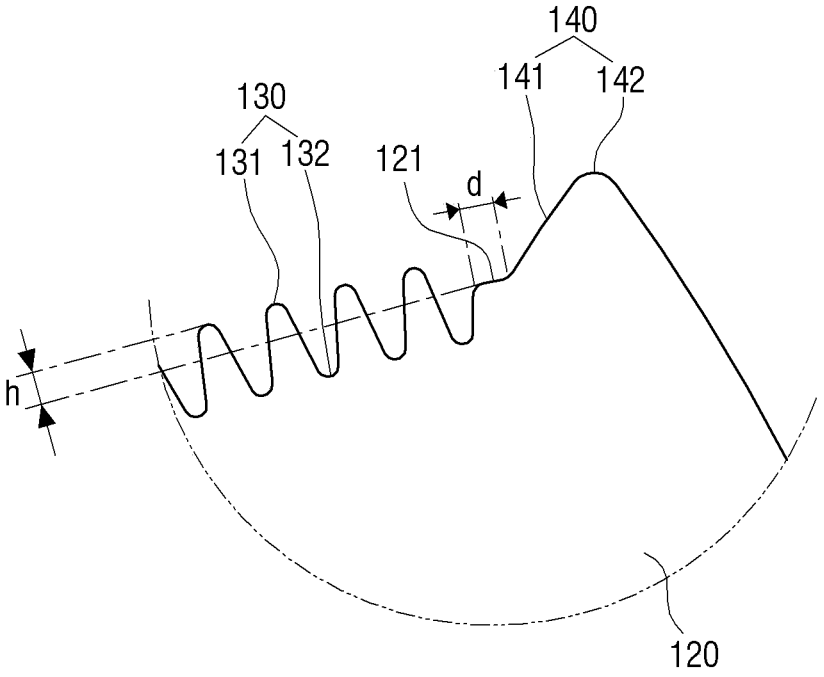
FIG. 4 is an enlarged view illustrating an A portion of the blower fan illustrated in FIG. 3.

FIG. 2 is a perspective view illustrating a figure of a blower fan according to an embodiment of the present invention and FIG. 3 is a front view illustrating a figure of a blower fan according to an embodiment of the present invention. Further, FIG. 4 is an enlarged view illustrating an A portion of the blower fan illustrated in FIG. 3. Referring to FIGS. 2 to 4, the blower fan 200 according to an embodiment of the present invention includes a hub 110 and a plurality of wings 120.

A shaft (not shown) of a driving member (not shown) may be coupled to the hub 110. The hub 110 is firmly coupled to the shaft of the driving member through a screw fastening structure and the like and receives rotational force from the shaft. Accordingly, the blower fan 200 may be rotated through the driving force of the driving member. For example, the driving member may be a driving motor.

The wings 120 may be radically arranged in a circumference of the hub 110 at intervals. The plurality of wings 120 may be provided in the same shape. Each of the wings 120 may be provided to have a gentle slope so as to blow the air in the rear of the blower fan 200 to a forward direction along an axis direction.

The wing 120 may include a trailing edge 121 and a leading edge 122. The leading edge 122 refers to a front edge portion with respect to a rotational direction (a clockwise direction on the basis of FIG. 3) of the wing 120 and the trailing edge 121 refers to a rear edge portion with respect to the rotational direction of the wing 120. The leading edges 122 and the trailing edges 121 of the wings may be arranged close to each other to face each other.

The air flowing into a wing 120 side through the leading edge 122 according to the rotation of the blower fan 200 flows along the front surface of the wing 120 and is discharged from the trailing edge 121. The wing 120 may be provided to have a gentle slope toward the front of the blower fan 200 from the leading edge 122 toward the trailing edge 121. Accordingly, in response to the rotation of the blower fan 200, the air flowing into the leading edge 122 may flow along the front surface of the wing 120 inclined toward the front of the blower fan 200 and thus the air may be blown along the axis direction of the blower fan 200 from the rear of the blower fan 200 to the front thereof.

The trailing edge 121 may have an uneven part 130 and a tail wing part 140. The uneven part 130 may have a protruding portion 131 and a recessed portion 132 so that the trailing edge 121 is curved. The protruding portion 131 and the recessed portion 132 are alternately arranged so that the uneven part 130 may have a curved shape.

For example, the protruding portion 131 may have a crest shape of a wave and the recessed portion 132 may have a trough shape of the wave. Accordingly, the uneven part 130 may have a wave shape having the crest and trough periodically. The protruding portion 131 and the recessed portion 132 may have a preset curvature.

The protruding portion 131 protrudes from a surface of the trailing edge 121 and the recessed portion 132 may be recessed from the surface of the trailing edge 121. A position P2 of the uneven part 130 may be located in a section $0.5*D \leq P2 \leq 0.9*D$ on the basis of a distance (hereinafter, referred to as maximum straight distance D) from the center C of the hub 110 to an end portion of the wing 120.

Here, the position P2 of the uneven part 130 means that the uneven part 130 may be located in the section $0.5*D \leq P2 \leq 0.9*D$ in the distance D from the center C of the hub 110 to the end portion of the wing 120 and the position P2 of the uneven part 130 may correspond to a length of the uneven part 130. A width of the uneven part 130 in the position P2 may be flexibly changed within the section $0.5*D \leq P2 \leq 0.9*D$.

The tail wing part 140 may be located in the outer side of the uneven part 130 and have an inclined portion 141 and a convex portion 142. The convex portion 142 is formed in the outer side of the uneven part 130. The convex portion 142 is arranged in the outer side of the uneven part 130 and has a protruding shape from the trailing edge 121. The convex portion 142 may have a preset curvature to protrude toward a rear side with respect to the rotational direction of the blower fan 200 and a front end of the convex portion 142 may be formed higher than a front end of the protruding portion 131.

The inclined portion 141 is coupled to an inner side of the convex portion 142 and is coupled to be inclined upward toward the convex portion 142. Although the inclined portion 141 is illustrated in a linear shape, the inclined portion 141 may have a curved form to be inclined upward toward the convex portion 142. A position P1 of the tail wing part 140 may be located in a section $0.85*D \leq P1 \leq D$ on the basis of the maximum straight distance D.

Here, the position P1 of the tail wing part 140 means that the tail wing part 140 may be located in the section $0.85*D \leq P1 \leq D$ in the distance D from the center C of the hub 110 to the end portion of the wing 120. Here, the outer end of the tail wing part 140 may be arranged in the end portion of the wing 120. The width of the tail wing part 140 may have the largest width in response to the inner end of the tail wing part 140 being arranged in 0.85*D. For example, the width of the tail wing part 140 may be 0.15*D. In response to an inner portion of the tail wing part 140 being located in a section between 0.85*D and D, the width of the tail wing part 140 may be flexibly changed.

Referring to FIG. 4, the uneven part 130 may be formed from an inner side of the tail wing part 140 (or inclined portion 141) toward the center C of the hub 110 and a pitch of the uneven part 130 may be located to have an interval d of 0.01*D or less on the basis of the maximum straight distance D. The protruding portion 131 may protrude to a present height h from the surface of the trailing edge 121.

Figure 5:
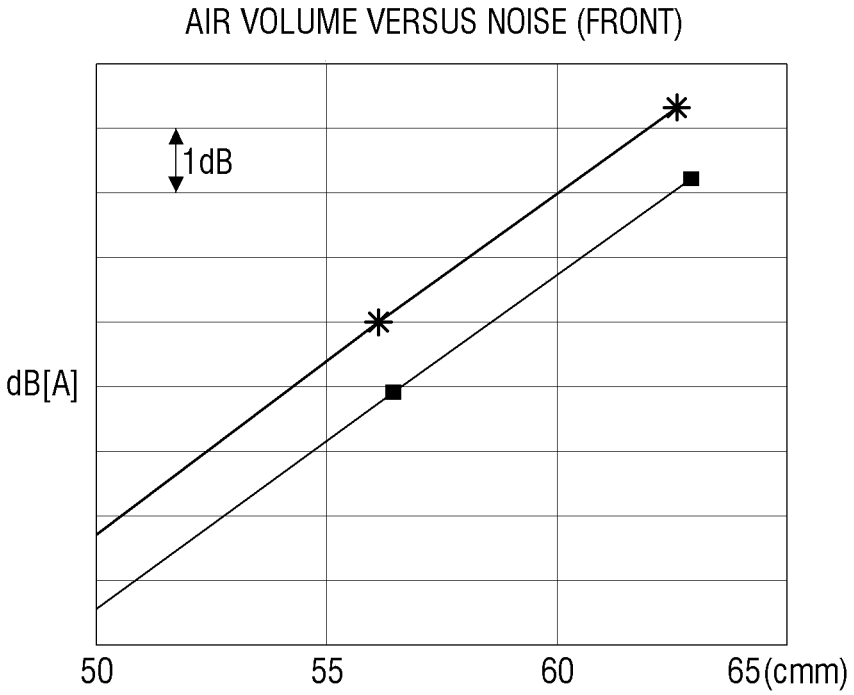
FIG. 5 is a diagram illustrating a comparison between a magnitude of noise to an air volume in a blower fan according to an embodiment of the present invention and a magnitude of noise to an air volume in a blower fan in the related art.
Figure 6:
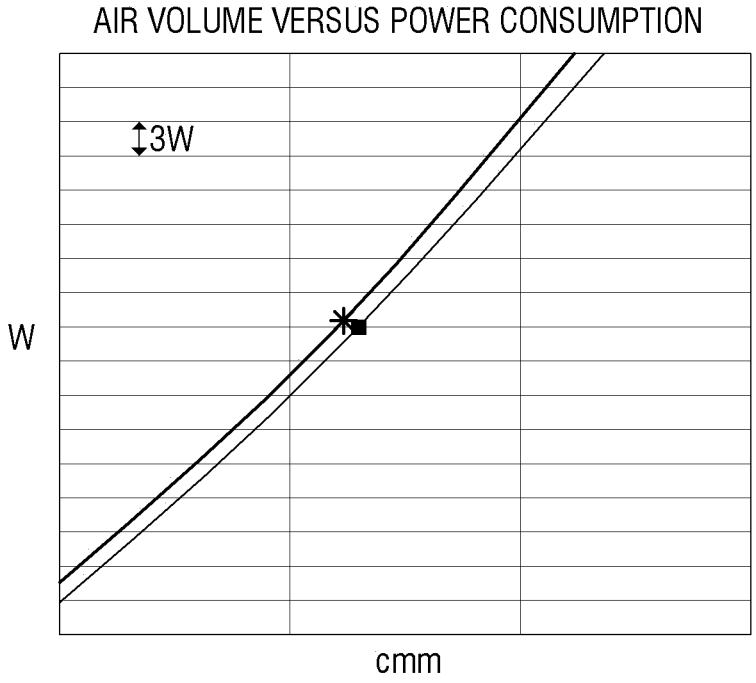
FIG. 6 is a diagram illustrating a comparison between a value of power consumption to an air volume in a blower fan according to an embodiment of the present invention and a value of power consumption to an air volume in a blower fan in the related art.

FIG. 5 is a diagram illustrating a comparison between a magnitude of noise to an air volume in a blower fan according to an embodiment of the present invention and a magnitude of noise to an air volume in a blower fan (in which an uneven part and a tail wing part are not included) in the related art and FIG. 6 is a diagram illustrating a comparison between a value of power consumption to an air volume in a blower fan according to an embodiment of the present invention and a value of power consumption to an air volume in a blower fan (in which an uneven part and a tail wing part are not included) in the related art.

It can be seen from FIG. 5 that the blower fan 200 according to an embodiment of the present invention has an effect that the noise of about 1 dBA is reduced under the same air volume condition as compared with a blower fan in the related art.

It can be seen from FIG. 6 that the blower fan 200 according to an embodiment of the present invention has an effect that the power consumption of about 3 W is reduced under the same air volume condition as compared with a blower fan in the related art.

Accordingly, the mixing action of the flow of a pressure surface and the flow of a negative pressure surface may be increased by forming the uneven part 130 and the tail wing part 140 in the wing 120 and thus the counter current strength of the counter current region and the counter current region in a slipstream may be reduced. As the counter current is reduced, the power consumption of the blower fan 200 may be reduced and the noise which may be generated in air suction and discharge process may be reduced and thus the satisfaction of the user may be improved.

The uneven part 130 and the tail wing part 140 may be provided to correspond to each wing 120. A shape, a size, the number of uneven parts 130 and the like are not limited thereto and may be changed according to the structure and shape of the applied blower fan 200. The shapes of the plurality of protruding portions 131 and recessed portions 132 constituting the uneven part 130 may be differently formed from each other. For example, the height of the protruding portion 131 close to the hub 110 may be formed larger than the protruding portion 131 close to the tail wing part 140.

Hereinafter, modification examples of the wing 120 according to an embodiment described in FIGS. 1 to 4 will be described. The modification examples to be described later will be described on the basis of a difference from the wing described in FIGS. 1 to 4 and omitted description may be replaced with the above-described contents.

Figure 7:
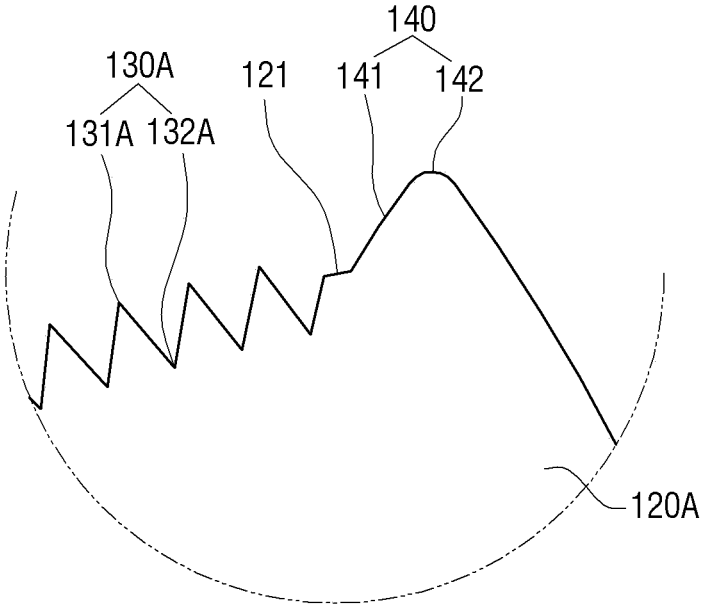
FIG. 7 is a diagram illustrating a modified example of a wing illustrated in FIG. 4.
Figure 8:
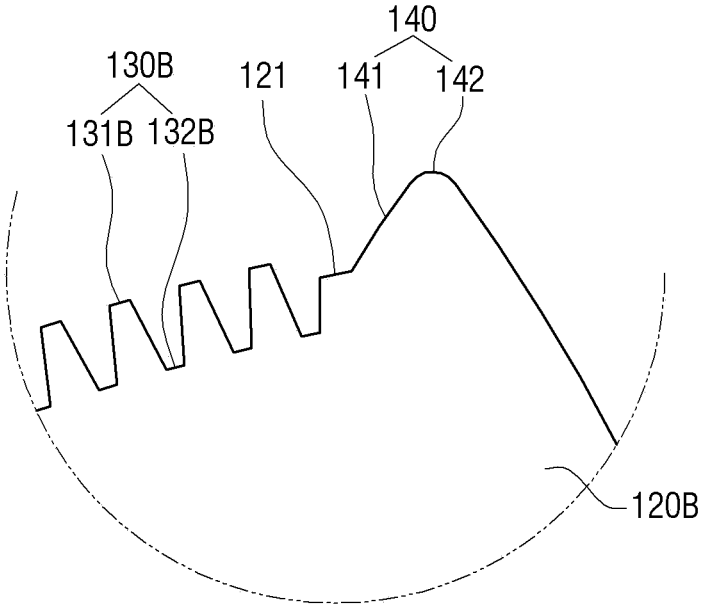
FIG. 8 is a diagram illustrating another modified example of a wing illustrated in FIG. 4.

FIG. 7 is a diagram illustrating a modified example of the wing illustrated in FIG. 4 and FIG. 8 is a diagram illustrating another modified example of the wing illustrated in FIG. 4. As illustrated in FIGS. 7 and 8, uneven parts 130A and 130B may have a polygonal shape.

Referring to FIG. 7, a protruding portion 131A may have a triangular shape. The protruding portion 131A may have an equilateral triangular shape or an isosceles triangular shape of which a cross-sectional area is constantly reduced upward.

The protruding portions 131A may be continuously arranged at intervals and the recessed portions 132A may be formed between the protrusion portions 131A. The protruding portions 131A and the recessed portions 132A may have a symmetrical shape with each other with respect to the surface of the trailing edge 121. The protruding portion 131A may be provided to protrude from the trailing edge 121 and the recessed portion 132A may be provided to be recessed from the trailing edge 121.

Referring to FIG. 8, the protruding portion 131B may have a trapezoidal shape of which a cross-sectional area is constantly reduced upward. The protruding portions 131B may be continuously arranged at intervals and the recessed portions 132B may be formed between the protrusion portions 131B. The protruding portions 131B and the recessed portions 132B may have a symmetrical shape with each other with respect to the surface of the trailing edge 121. The protruding portion 131B may be provided to protrude from the trailing edge 121 and the recessed portion 132B may be provided to be recessed from the trailing edge 121.

Figure 9:
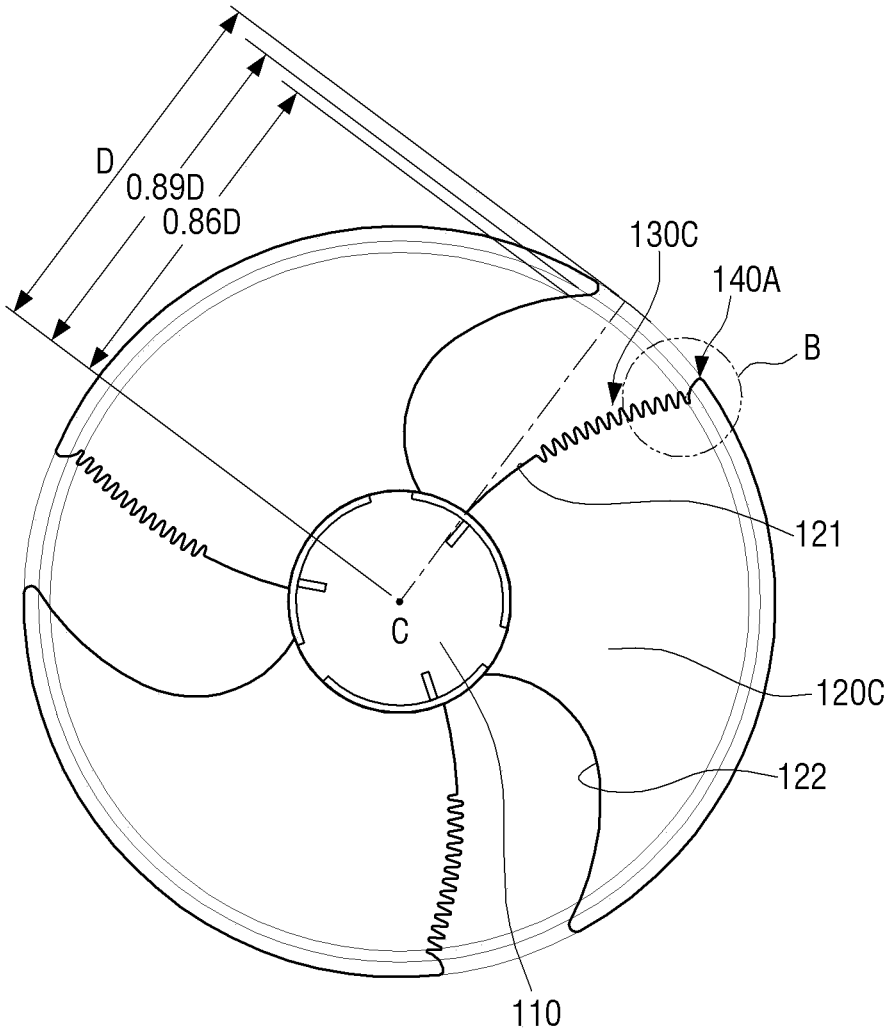
FIG. 9 is a front view illustrating a blower fan according to another embodiment of the present invention.
Figure 10:
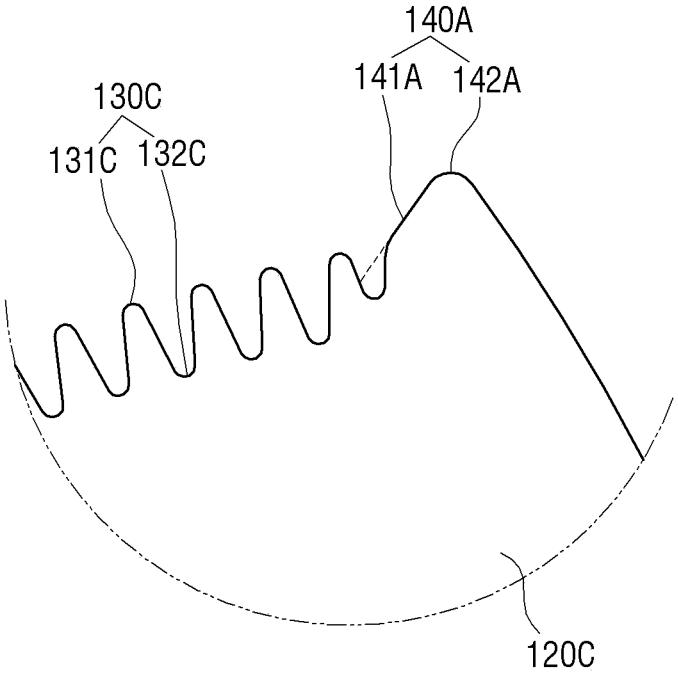
FIG. 10 is an enlarged view illustrating a B portion of the blower fan illustrated in FIG. 9.

FIG. 9 is a front view illustrating a blower fan according to another embodiment of the present invention and FIG. 10 is an enlarged diagram illustrating a B portion of the blower fan illustrated in FIG. 9. As described in FIGS. 1 to 4, a protruding portion 131C protrudes the surface of the trailing edge 121 and a recessed portion 132C is recessed from the surface of the trailing edge 121.

A position P2' of an uneven part 130C may be located in a section $0.5*D \leq P2' \leq 0.9*D$ on the basis of the maximum straight distance D.

A tail wing part 140A may have an inclined portion 141A and a convex portion 142A. The convex portion 142A is formed in the outer side of the uneven part 130C. The convex portion 142A is arranged on the outer side of the uneven part 130C and has a protruding shape from the trailing edge 121. The convex portion 142A may have a preset curvature to protrude toward a rear side with respect to the rotational direction of the blower fan 200 and a front end of the convex portion 142A may be formed higher than a front end of the protruding portion 131C.

The inclined portion 141A is coupled to an inner side of the convex portion 142A and is arranged to be inclined upward toward the convex portion 142A. A position P1' of the of the tail wing part 140A may be located in a section $0.85*D \leq P1' \leq D$ on the basis of the maximum straight distance D.

Referring to FIGS. 9 and 10, the uneven part 130C may be formed on the tail wing part 140A.

Here, the position P1' of the tail wing part 140A means that the tail wing part 140A may be located in the section $0.85*D \leq P1' \leq D$ in the distance D from the center C of the hub 110 to an end portion of a wing 120C. Here, the outer end of the tail wing part 140A may be the end portion of the wing 120C.

At this time, the width of the tail wing part 140A may have the largest width in response to the inner end of the tail wing part 140A being arranged in 0.85*D. In response to an inner portion of the tail wing part 140A being located in a section between 0.85*D and D, the width of the tail wing part 140A may be flexibly changed.

Here, the position P2' of the uneven part 130C means that the uneven part 130C may be located in the section $0.5*D \leq P2' \leq 0.9*D$ in the distance D from the center C of the hub 110 to the edge portion of the wing 120C. The width of the uneven part 130C may be flexibly changed in the section $0.5*D \leq P2' \leq 0.9*D$.

For example, in response to the position P1' of the tail wing part 140A being formed in $0.86*D \leq P1' \leq D$, the position P2' of the uneven part 130C may be formed in $0.5*D \leq P2' \leq 0.89*D$. In this case, the position P2' of the uneven part 130C may be formed to partially overlap the position P1' of the tail wing part 140A ($0.86*D \leq P1' \cap P2' \leq 0.89*D$). In response to a distance ratio of the inclined portion 141A and the convex portion 142A being 1:1, the uneven part 130C may be formed on the inclined portion 141A.

In the blower fans 200 described in the embodiments of the present invention, air flows in along the leading edge 122. The flowing-in air flows along the wing 120 and the flow of the air may be changed through the uneven part 130 and the tail wing part 140 provided in the trailing edge 121 in response to the air being discharged to the training edge 121.

At this time, since the blower fan 200 can mix the flow of the pressure surface and the flow of the negative pressure surface near the uneven part 130, the blower fan 200 may effectively reduce the strength and region of the counter current which may be generated in the discharged air. The blower fan can simultaneously reduce the noise and power consumption through control of the generation of the counter current.

The various embodiments of the present invention have been separately described above, but the embodiments may not be inevitably separately implemented and the configuration and operation of each of the embodiments may be implemented through the combination of at least one of other embodiments.

The foregoing exemplary embodiments and advantages are merely exemplary and are not to be construed as limiting the present inventive concept. The description of the exemplary embodiments is intended to be illustrative, and not to limit the scope of the claims, and many alternatives, modifications, and variations will be apparent to those skilled in the art.

The invention claimed is:

1. A blower fan comprising:
- a hub coupled to a driving member and configured to receive rotation force; and
- a plurality of wings radially arranged along a circumference of the hub,
- wherein each of the plurality of wings includes:
  - a trailing edge at a rear edge portion of a wing with respect to a rotational direction thereof,
  - an uneven part formed at the trailing edge and including a plurality of protruding portions protruding from a surface of the trailing edge and a plurality of recessed portions recessed from the surface of the trailing edge, wherein the plurality of protruding portions and the plurality of recessed portions have a symmetrical shape with each other with respect to the surface of the trailing edge, and
  - a tail wing part having a convex portion which is formed on an outer side of the uneven part and protrudes farther than the uneven part.

2. The blower fan according to claim 1, wherein:
- a maximum straight distance (D) is from a center (C) of the hub to an end portion of the wing, and
- a position P1 of the tail wing part is located in a section based on $0.85*D \leq P1 \leq D$.

3. The blower fan according to claim 2, wherein a position P2 of the uneven part is located in the section based on $0.5*D \leq P2 \leq 0.9*D$.

4. The blower fan according to claim 3, wherein the uneven part is located from an inner end of the tail wing part toward the center (C) of the hub by an interval of 0.01*D or less.

5. The blower fan according to claim 1, wherein the tail wing part has an inclined portion that is coupled to an inner side of the convex portion and is arranged to be inclined upward toward the convex portion.

6. The blower fan according to claim 1, wherein a protruding portion of the uneven part which protrudes from a surface of the trailing edge and a recessed portion of the uneven part which is recessed from the surface of the trailing edge are alternately arranged and the recessed portion is located closest to the convex portion.

7. The blower fan according to claim 6, wherein the protruding portion has a convex shape to have a preset curvature.

8. The blower fan according to claim 6, wherein the protruding portion has a polygonal shape.

9. The blower fan according to claim 1, wherein the convex portion has a convex shape to have a preset curvature and protrudes backward farther than the uneven part with respect to the rotational direction.

10. The blower fan according to claim 2, wherein an outer end of the tail wing part is located in the end portion of the wing.

11. An air conditioner comprising:

a blower fan configured to cool a refrigerant, wherein the blower fan has a plurality of wings, and wherein each of the plurality of wings includes:

a trailing edge at a rear edge portion of a wing with respect to a rotational direction thereof, an uneven part formed at the trailing edge and including a plurality of protruding portions protruding from a surface of the trailing edge and a plurality of recessed portions recessed from the surface of the trailing edge, wherein the plurality of protruding portions and the plurality of recessed portions have a symmetrical shape with each other with respect to the trailing edge; and a convex portion formed on an outer side of the uneven part and having a preset curvature to protrude backward farther than the uneven part with respect to the rotational direction.

12. The air conditioner according to claim 11, wherein the wing further includes a tail wing part formed in an end portion of the trailing edge of the wing and the convex portion is provided in the tail wing part.

13. The air conditioner according to claim 12, wherein:

the blower fan further includes a hub coupled to a driving shaft and configured to receive rotation force, the plurality of wings are arranged along a circumference of the hub, a maximum straight distance (D) is from a center (C) of the hub to an end portion of the wing, and a position P1 of the tail wing part is located in a section based on $0.85*D \leq P1 \leq D$.

14. The air conditioner according to claim 13, wherein a position P2 of the uneven part is located in a section $0.5*D \leq P2 \leq 0.9*D$.

15. The air conditioner according to claim 14, wherein the uneven part is located from an inner end of the tail wing part toward the center (C) of the hub by a section of 0.01*D or less.

* * * * *